US005254019A

United States Patent [19]

Noschese

[11] Patent Number: 5,254,019

[45] Date of Patent: Oct. 19, 1993

[54] CONFIGURABLE CODED ELECTRICAL PLUG AND SOCKET

[75] Inventor: Rocco J. Noschese, Wilton, Conn.

[73] Assignee: Burndy Corporation, Norwalk, Conn.

[21] Appl. No.: 911,556

[22] Filed: Jul. 8, 1992

[51] Int. Cl.[5] ..... H01R 13/64

[52] U.S. Cl. ..... 439/681; 439/701

[58] Field of Search ..... 439/677, 680, 681, 695, 439/701

[56] References Cited

U.S. PATENT DOCUMENTS

| | | | |
|---|---|---|---|
| 3,426,315 | 2/1969 | DeTar . | |
| 3,491,330 | 1/1970 | Barnhart et al. | 439/681 |
| 3,950,059 | 4/1976 | Anhalt et al. . | |
| 4,350,409 | 9/1982 | Kato et al. | 439/681 |
| 4,365,857 | 12/1982 | Watanabe et al. . | |
| 4,415,214 | 11/1983 | Obst | 439/681 X |
| 4,925,400 | 5/1990 | Blair et al. | 439/374 |
| 5,041,025 | 8/1991 | Haitmanek | 439/681 |
| 5,044,994 | 9/1991 | Van Woensel | 439/681 |

FOREIGN PATENT DOCUMENTS 586962 4/1977 Switzerland .

*Primary Examiner*—Larry I. Schwartz
*Assistant Examiner*—Khiem Nguyen
*Attorney, Agent, or Firm*—Perman & Green

[57] ABSTRACT

Coding modules are connected to an electrical plug and an electrical socket to control whether or not the plug and socket can be connected to each other. Each module has a frame and two keys connected to their frames. The keys are selectively positionable on the frames to provide at least sixteen different key configurations for each module. The modules are snap-lock connected to the electrical plug and socket such that the module key configurations must be arranged in a complementary fashion before the plug and socket can be connected to each other.

20 Claims, 2 Drawing Sheets

CONFIGURABLE CODED ELECTRICAL PLUG AND SOCKET

BACKGROUND OF THE INVENTION

1. Field of the Invention

The present invention relates to electrical connectors and, more particularly, to a coding system to allow connection of connectors to each other only upon having a matched configuration.

2. Prior Art

U.S Pat. No. 5,041,025 to Haitmanek discloses a multi-positionable key for interconnectable components. U.S. Pat. No. 3,426,315 to DeTar discloses electrical connectors with studs adapted to mate with each other having thirty-six different matching positions. U.S. Pat. No. 5,044,994 to Van Woensel discloses a connector assembly with various different types of mating coding elements. U.S. Pat. No. 4,925,400 to Blair et al. discloses the use of an octagonal keying element on a mother board and corresponding keying elements on a module connector.

One of the problems encountered with keying and coding systems in the prior art is that most of them are not easily configurable. Another problem is that such prior art systems occupy excessive space making connectors significantly larger than otherwise would be necessary. Another problem is that with systems, such as disclosed in U.S. Pat. No. 5,044,994, that provide many different configurations, the large variety of coding elements increases inventory and manufacturing costs.

SUMMARY OF THE INVENTION

In accordance with one embodiment of the present invention an electrical connector is provided comprising a housing, electrical contacts mounted to the housing, and a coding module connected to the housing. The coding module comprises a frame and at least two keys. The frame is connected to the housing with a window with each key. The windows are oriented towards a path of insertion with a second connector. Each key has a keying section located in one of the windows thereby blocking a portion of each window. The keying sections are suitably positioned in the windows to provide a plurality of different blocked window patterns.

In accordance with another embodiment of the present invention an electrical connector coder is provided comprising a frame and a key. The frame has a key receiving area and means for connecting the frame to a first electrical connector. The key has a mounting base and an off-center polarizing section. The key is positionable in the frame at a variety of orientations in the key receiving area such that the off-center polarizing section occupies a predetermined portion of the key receiving area. The key and the key receiving area are adapted to allow connection of the first electrical connector with a second electrical connector having a second coder upon the keys of the two coders being cooperatingly matched to align adjacent each other, but otherwise prevent connection of the two electrical connectors to each other.

In accordance with another embodiment of the present invention an electrical connector assembly is provided comprising a first connector, a second connector, a first coder module, and a second coder module. The second connector is adapted to electrically and mechanically connect to the first connector. The first coder module is connected to the first connector and comprises a first frame and at least two first keys. The second coder module is connected to the second connector and comprises a second frame and at least two second keys. The second frame has a window for each of the second keys. The second keys are located at least partially in the windows and are positionable at a variety of orientations in the windows to provide a variety of different blocked window configurations wherein the first and second connectors can be connected to each other with the first keys located in the windows adjacent the second keys when the first and second keys are cooperatingly arranged, but otherwise prevents connection of the connectors to each other.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
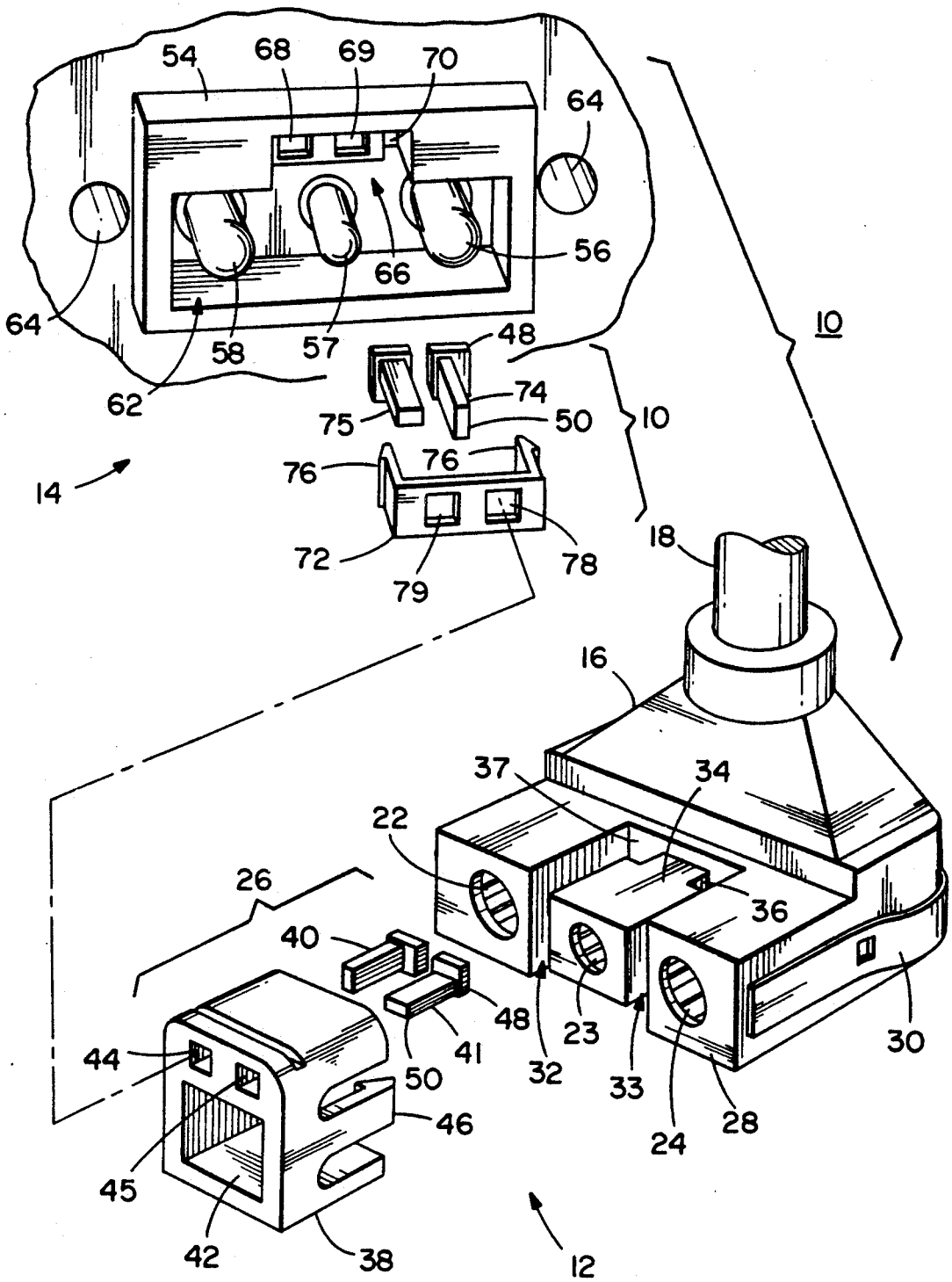
FIG. 1 is an exploded perspective view of a connector assembly incorporating features of the present invention.

Referring to FIG. 1 there is shown an exploded perspective view of a connector assembly 10 incorporating features of the present invention. The assembly 10 generally comprises an electrical plug connector 12 and an electrical socket connector 14. The assembly 10, in the embodiment shown, is for a three phase power connection. However, the present invention could be used for any suitable type of connection where coding is desired or required. In addition, any suitable size, shape or type of elements or materials could be used to practice the present invention.

The plug 12, in the embodiment shown, is part of a cable assembly 16. The cable assembly 16 has a cable 18 with three electrical conductors therein. The plug 12 has a housing 20, three contacts 22, 23, 24, and a coding module 26. The housing 20 has a front end 28 with three contact receiving areas having the contacts 22–24 located therein. Latches 30 are provided on the lateral sides of the housing 20 to latch the plug 12 with the socket 14. In the embodiment shown, the front end 28 has two slots 32, 33 to form a peninsula or mounting post 34 having the contact 23 therein and, forming an area for receiving the coding module 26 as further understood below. The rear end of the peninsula 34 has recessed areas 36, 37 that function as latches for snap locks on the coding module 26.

The plug coding module 26 generally comprises a frame 38 and two keys 40, 41. The frame 38 has a main receiving area 42, two key windows 44, 45, and two snap-lock latches 46 at the sides of the frame. The sides of the frame 38 are suitably sized to fit into the housing slots 32, 33. The main receiving area 42 is suitably sized and shaped to receive the peninsula 34 therein. The snap-lock latches 46 are adapted to snap into the recessed areas 36, 37 when the module 26 is connected to the housing 20. In the embodiment shown, the module 26 can be connected to the housing 20 in two orientations; either the orientation shown in FIG. 1 or an upside-down orientation from that shown in FIG. 1. When the module 26 is connected to the housing 20 its front face is flush with the front face of the housing front 28. Its bottom face is also flush with the bottom of the housing. Once the frame 2 is connected to the housing 20, it is not removable because the snap-lock latches 46 are then hidden. However, in an alternate embodiment, the frame 26 may be removable.

Figure 2:
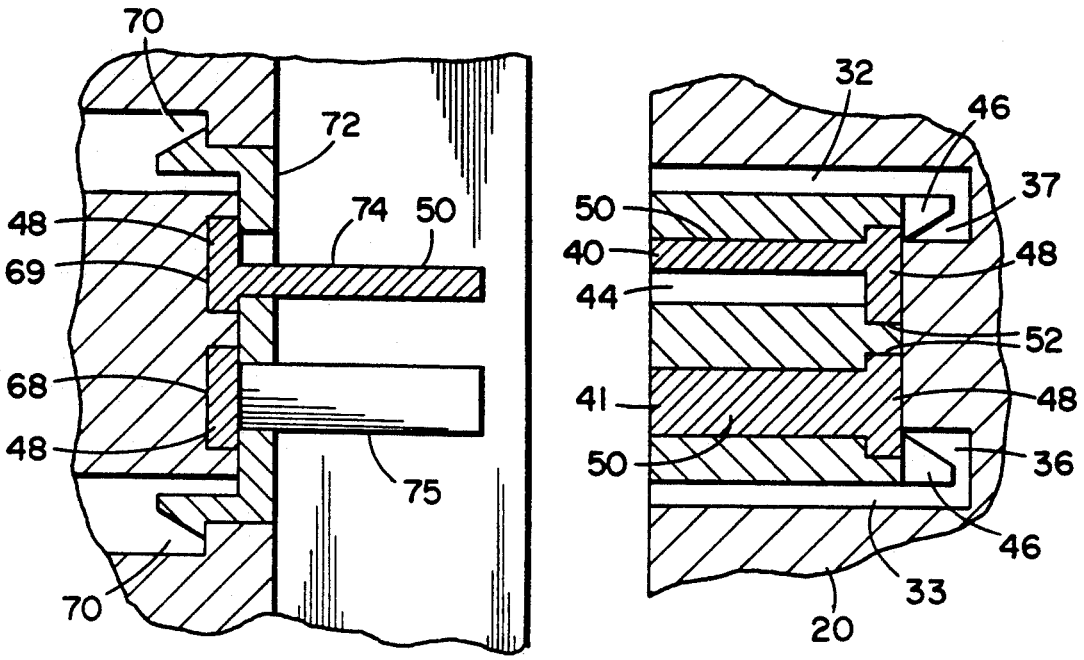
FIG. 2 is a cross sectional view of the coding sections of the electrical plug and socket shown in FIG. 1.

Referring also to FIG. 2, the keys 40 and 41 are substantially identical to each other and each comprises a base 48 and an off-center keying section 50. The base 48 is slightly larger then the size of the front of the key windows 44, 45. The key windows 44, 45 are substantially identical and have a square cross-sectional shape. A rear portion 52 of each window 44, 45 has an area suitably sized and shaped to receive a base 48 and sandwich the base against the housing 20. In this manner, the keys 40 and 41 can be stably and fixedly positioned in the frame 38. As noted above, the keys each have an off-center keying section 50. In the embodiment shown, the section 50 has a rectangular cross-sectional shape equal to about one-half the cross-sectional area of one of the windows 44, 45. However, any suitably shaped windows and keys could be provided. In addition, more or less then a two key/window configuration could be provided. In the embodiment shown, each of the keys is positionable into one window in four different orientations; each orientation being 90° different along the longitudinal axis of the window. As can be seen with reference to FIG. 3, because the sections 50 only occupying about half of each window, various blocked window patterns or configurations can be provided. Because there are two key/window coding sections, there are sixteen possible code configurations. Open window areas 53 are thus provided to receive keys from the socket 14 as further understood below.

The socket 14, in the embodiment shown, has a housing 54, three contacts 56, 57, 58, and a coding module 60. The housing 54 has a receiving area 62 for receiving the front 28 of the plug 12. The contacts 56–58 are male contacts adapted to be received in the female contacts 22–24 of the plug 12. Of course, in an alternate embodiment, the plug 12 could have male contacts and the socket 14 could have female contacts. The housing 54 has two lateral side holes 64 for receiving retention locks (not shown). The retension locks are used with the latches 30 to fixedly, but removably latch the plug 12 to the socket 14. However, any suitable type of latching system could be used. In the embodiment shown, the receiving area 62 has an upper area 66 with two recesses 68, 69 and snap-lock areas 70. The socket coding module 60 generally comprises a frame 72 and two keys 74, 75. The keys 74, 75 are substantially identical to the keys 40, 41 and, thus, each comprise a base 48 and an off-center keying section 50. The frame 72 has two lateral snap-lock legs 76 and two windows 78, 79. The legs 76 are adapted to project into areas 70 in the housing 54 to snap-lock the frame 72 to the housing 54.

In the embodiment shown, the windows 78, 79 are slightly smaller than the bases 48 such that the frame 72 can retain the bases 48 of the keys 74, 75 in the recesses 68, 69. The off-center keying section 50 of the keys 74, 75 projects through the windows 78, 79 and extends out in front of the frame 72 a predetermined distance. The windows 78, 79 are substantially the same square cross-sectional size as the windows 44, 45. The off-center keying sections 50 of the keys 74, 75 have rectangular shapes and each one of the keys 74, 75 is adapted to be orientated at four different orientations on the housing 54. Therefore, similar to the plug coding module 26, the socket coding module 60 can provide sixteen window/-key configurations similar to those shown in FIG. 3. In a preferred embodiment, once the frame 72 is attached to the housing 54, the frame cannot be removed to thereby permanently set the coding configuration of the socket 14. However, in an alternate embodiment, the frame 72 may be removable to thereby allow the coding configuration to be altered or reconfigured if necessary.

Figure 3:
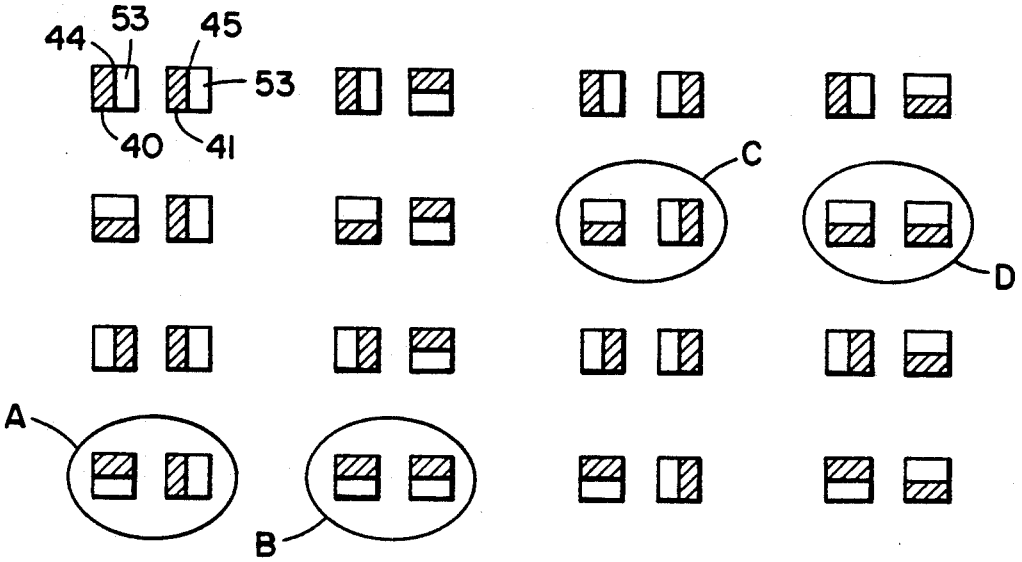
FIG. 3 is a diagrammatical view of the 16 possible window/code configurations of the coding sections shown in FIG. 2.

The primary purpose of the present invention is to allow electrical connectors to be coded to thereby prevent unmatched connectors from being connected to each other. In the present invention, this is accomplished by the use of configurable coding modules that are connected to the connectors. By use of configurable coding modules, manufacturing and inventory costs are reduced while nonetheless providing numberous coding configurations. FIG. 3 has several of the coding configurations lettered for indentification and description proposes. In the event the socket 14 has the code configuration A, the plug 12 must have the code configuration C in order for the plug to be connectable to the socket. If the two code configurations did not cooperatively match, the keys 40, 41 and 74, 75 would hit each other and thereby prevent connection of the plug 12 to the socket 14. Thus, the code configuration A would only match the code configuration C; not any of the other code configurations shown. Likewise, the code configuration B would only match the code configuration D; not any of the other code configurations shown. When the plug and socket are connected to each other, the key sections 50 of the keys 74, 75 project into the open windows areas 53 of the windows 44, 45.

Although the single embodiment shown in the drawings has been described in detail above, various alternatives are easily envisioned. The keys 40, 41 and 74, 75 could have any suitable shape. The windows 44, 45 and 78, 79 could have any suitable shape. More than two key/window sections could be provided for each connector. Each key could have more or less than four orientations. The frames and keys can be suitably configured such that the keys are fixed to the frames prior to connection of the modules to the connectors. Any suitable type of means to fixedly mount the keys to the frames could be provided.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector comprising:

a housing;

electrical contacts mounted to the housing; and a coding module connected to the housing, the coding module comprising a frame and at least two keys, the frame being connected to the housing with a window for each key, the windows being orientated towards a path of insertion with a second connector, each key having a keying section located in one of the windows thereby blocking a portion of each window, the windows being larger than the keying sections such that a receiving area is provided in each window next to the keying sections, the keying sections being selectably positionable in the windows to provide a plurality of different blocked window patterns.

2. A connector as in claim 1 wherein the frame includes snap-lock latches to connect the frame to the housing.

3. A connector as in claim 1 wherein the housing is adapted to have the coding module connected to the housing in at least two orientations.

4. A connector as in claim 1 wherein the housing has a mounting post that the coding module is mounted on.

5. A connector as in claim 1 wherein the coding module frame has a space for locating one of the electrical contacts therein.

6. A connector as in claim 1 wherein the coding module windows are generally square shaped and the keying sections each have a rectangular cross-section about half the cross-section area of one of the windows.

7. A connector as in claim 1 wherein the keys can be selectively positioned in the windows to provide at least sixteen different blocked window patterns.

8. A connector as in claim 1 wherein the housing has a receiving area to receive the coding module such that a front of the coding module frame is substantially flush with a front of the housing.

9. A connector as in claim 1 wherein leading portions of the keying sections extend out through the windows past a front of the coding module frame.

10. An electrical connector coder comprising:

a frame having a key receiving area and means for connecting the frame to a first electrical connector; and a key having a mounting base and an off-center polarizing section, the key being positionable in the frame at a variety of orientations in the key receiving area such that the off-center polarizing section occupies a predetermined portion of the key receiving area, wherein the key and the key receiving area are adapted to prevent connection of the first electrical connector with a second electrical connector unless the key of the coder is cooperatingly matched to align with an adjacent portion of the second connector when the two connectors are mated.

11. A coder as in claim 10 wherein the key polarizing section extends past a front of the frame.

12. A coder as in claim 10 wherein the frame has an area for receiving an electrical contact of the first electrical connector.

13. A coder as in claim 12 wherein the area for receiving an electrical contact of the first electrical connector is also adapted to receive a portion of the second electrical connector.

14. A coder as in claim 10 wherein the means for connecting the frame to the first electrical connector comprises two side snap-lock latches on the frame.

15. A coder as in claim 10 wherein the frame has at least two key receiving areas in the form of windows and, the coder has at least two keys, one key in each window.

16. A coder as in claim 10 wherein the key receiving area has a general square cross-sectional shape and the key polarizing section has a general rectangular cross-sectional shape occupying about half of the key receiving area.

17. A coder as in claim 10 wherein the key can be positioned in four different orientations in the key receiving area.

18. An electrical connector assembly comprising:

a first connector;

a second connector adapted to be electrically and mechanically connected to the first connector;

a first coder module connected to the first connector, the first coder module comprising a first frame and at least two first keys; and a second coder module connected to the second connector, the second coder module comprising a second frame and at least two second keys, the second frame having a window for each of the second keys, the second keys being located at least partially in the windows, the second keys being positionable at a variety of orientations in the windows to provide a variety of different blocked window configurations wherein the first and second connectors are prevented from being connected to each other unless the first keys are positioned to be located in the second coder module windows adjacent to the second keys.

19. An assembly as in claim 18 wherein the windows are generally cross-sectionally square in shape and the first and second keys have leading sections that have generally cross-sectionally rectangular shapes.

20. An assembly as in claim 18 wherein the first and second frames are snap-lock connected to the first and second connectors, respectively.

* * * * *